US009305472B1

(12) United States Patent
Pitts

(10) Patent No.: US 9,305,472 B1
(45) Date of Patent: Apr. 5, 2016

(54) ILLUMINATED TRAFFIC CONTROL PADDLE

(71) Applicant: Sure Stop, LLC, Phoenix, AZ (US)

(72) Inventor: Brian K. Pitts, Phoenix, AZ (US)

( * ) Notice: Subject to any disclaimer, the term of this patent is extended or adjusted under 35 U.S.C. 154(b) by 0 days.

(21) Appl. No.: 14/307,391

(22) Filed: Jun. 17, 2014

Related U.S. Application Data

(60) Provisional application No. 61/837,784, filed on Jun. 21, 2013.

(51) Int. Cl.
*G09F 13/00* (2006.01)

(52) U.S. Cl.
CPC ..... *G09F 13/00* (2013.01)

(58) Field of Classification Search
CPC ..... G09F 2013/0463; G09F 2013/0472
USPC ..... 40/586
See application file for complete search history.

(56) References Cited

U.S. PATENT DOCUMENTS 2,409,957 A * 10/1946 Reynolds ..... 340/908
5,023,607 A * 6/1991 Staten ..... 340/908.1
5,755,051 A * 5/1998 Zumbuhl ..... 40/586
6,204,777 B1 * 3/2001 Lyons ..... 340/908
6,222,462 B1 * 4/2001 Hahn ..... 340/904
6,693,556 B1 2/2004 Jones et al.
7,926,212 B2 * 4/2011 Fisher ..... 40/541
8,098,172 B2 * 1/2012 Graham ..... 340/908
2005/0062616 A1 * 3/2005 Vernon-Dier et al. ..... 340/908
2006/0061487 A1 * 3/2006 Heap ..... 340/908
2007/0113445 A1 * 5/2007 Chambless ..... 40/586

* cited by examiner

*Primary Examiner* — Shin Kim

(74) *Attorney, Agent, or Firm* — Thomas W. Galvani, P.C.; Thomas W. Galvani

(57) ABSTRACT

A traffic control paddle includes a frame with a handle and a head having two sides. The head has a perimeter, a face inset within the perimeter, a surface on the face carrying literal indicia, and an upstanding lip extending around the perimeter and projecting above the face by a first distance. Two spaced-apart light-emitting diodes in the face are seated in annular projections, each of which projects above the face by a second distance. The handle carries batteries and a switch to provide power to the light-emitting diodes. The light-emitting diodes are spaced above and below the literal indicia on the face and are programmed to blink.

17 Claims, 4 Drawing Sheets

ILLUMINATED TRAFFIC CONTROL PADDLE

CROSS-REFERENCE TO RELATED APPLICATIONS

This application claims the benefit of U.S. Provisional Application No. 61/837,784, filed Jun. 21, 2013, which is hereby incorporated by reference.

FIELD OF THE INVENTION

The present invention relates generally to safety equipment, and more particularly to traffic control safety equipment.

BACKGROUND OF THE INVENTION

Crossing guards play a vitally important role in school safety. Crossing guards stand watch and control traffic at crosswalks to allow school children to cross safely from one side of the street to the other. Crossing guards alert traffic of the presence of a child or adult near a crosswalk or actually in a crosswalk, and then signal traffic to stop before the crosswalk. Guards are needed because children are small, difficult to see, and can be unpredictable in their movement around traffic.

Distracted driving is known to be a serious problem, not just on highways but on surface streets. Drivers who are drunk, sleepy, talking, or texting on a mobile phone give less than their full attention to the road, traffic in the road, and other conditions on the road. Such drivers often fail to see oncoming traffic, changing traffic signals, and pedestrian traffic in or near the roadway. As such, distracted drivers have become a scourge to road safety.

Distracted drivers are a danger to children walking in school crosswalks. Crossing guards have reported that the number of drivers who have failed to slow, or even failed to stop, in a school crosswalk, has increased in the past few years. Many believe this escalation has been the result of drivers talking or texting on mobile phones who fail to appreciate the changing conditions of the road. An improved method of alerting drivers, and distracted drivers especially, of nearby crosswalks is needed.

SUMMARY OF THE INVENTION

An illuminated traffic control paddle includes a head with a handle formed integrally to the head. The head has opposed sides, each of which carry sensible literal indicia and light-emitting diodes which blink rapidly to attract the attention of oncoming motorists. The head has a perimeter, a face inset within the perimeter, and an upstanding lip extending continuously around the perimeter. The light-emitting diodes are seated in annular projections. The upstanding lip and the annular projections project above the face of the head by an equal distance.

BRIEF DESCRIPTION OF THE DRAWINGS

Referring to the drawings.

DETAILED DESCRIPTION

Figure 1:
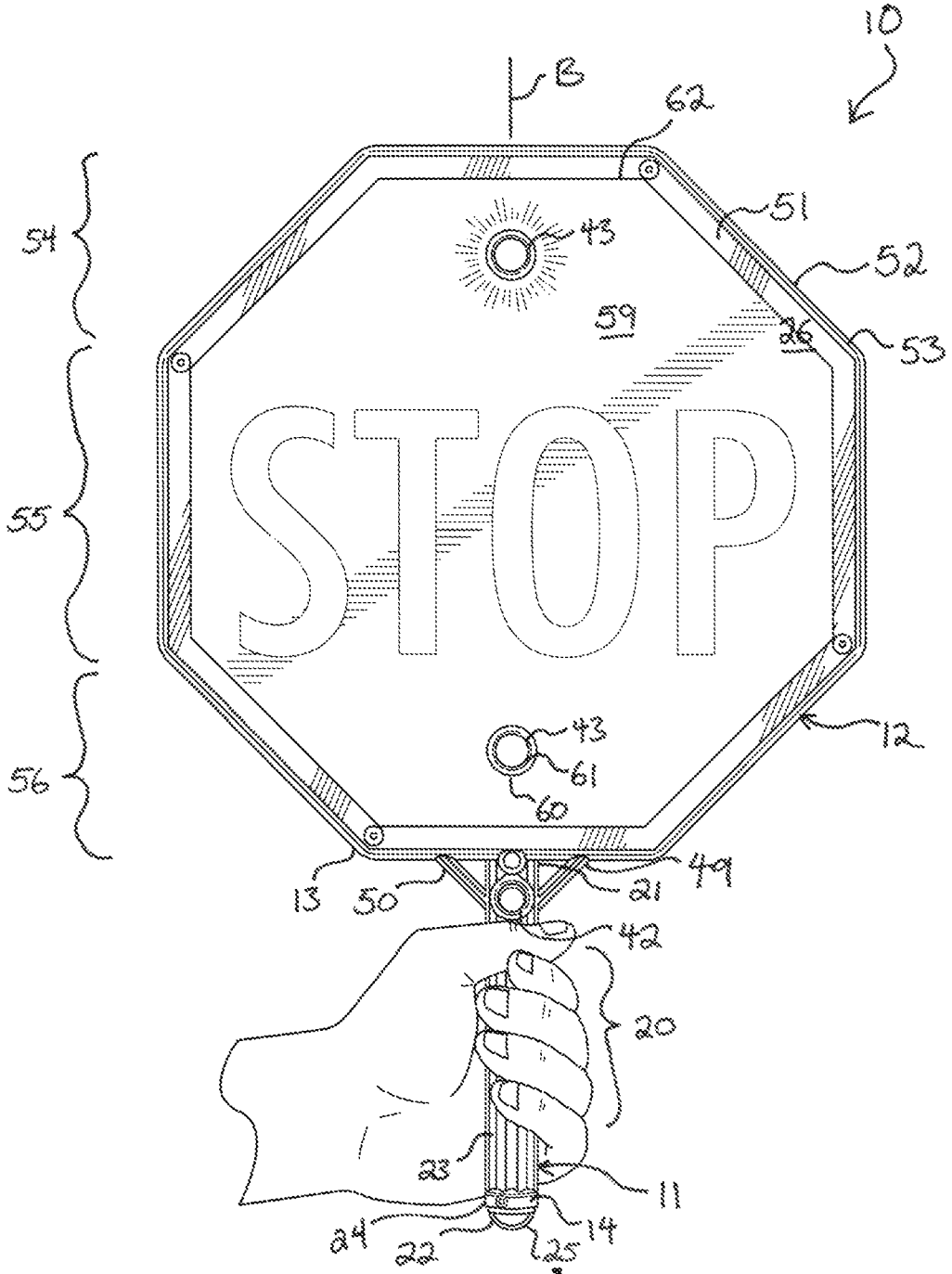
FIG. 1 is a front elevation view of an illuminated traffic control paddle constructed and arranged in accordance with the principle of the invention, illustrating a front half of the paddle.
Figure 2:
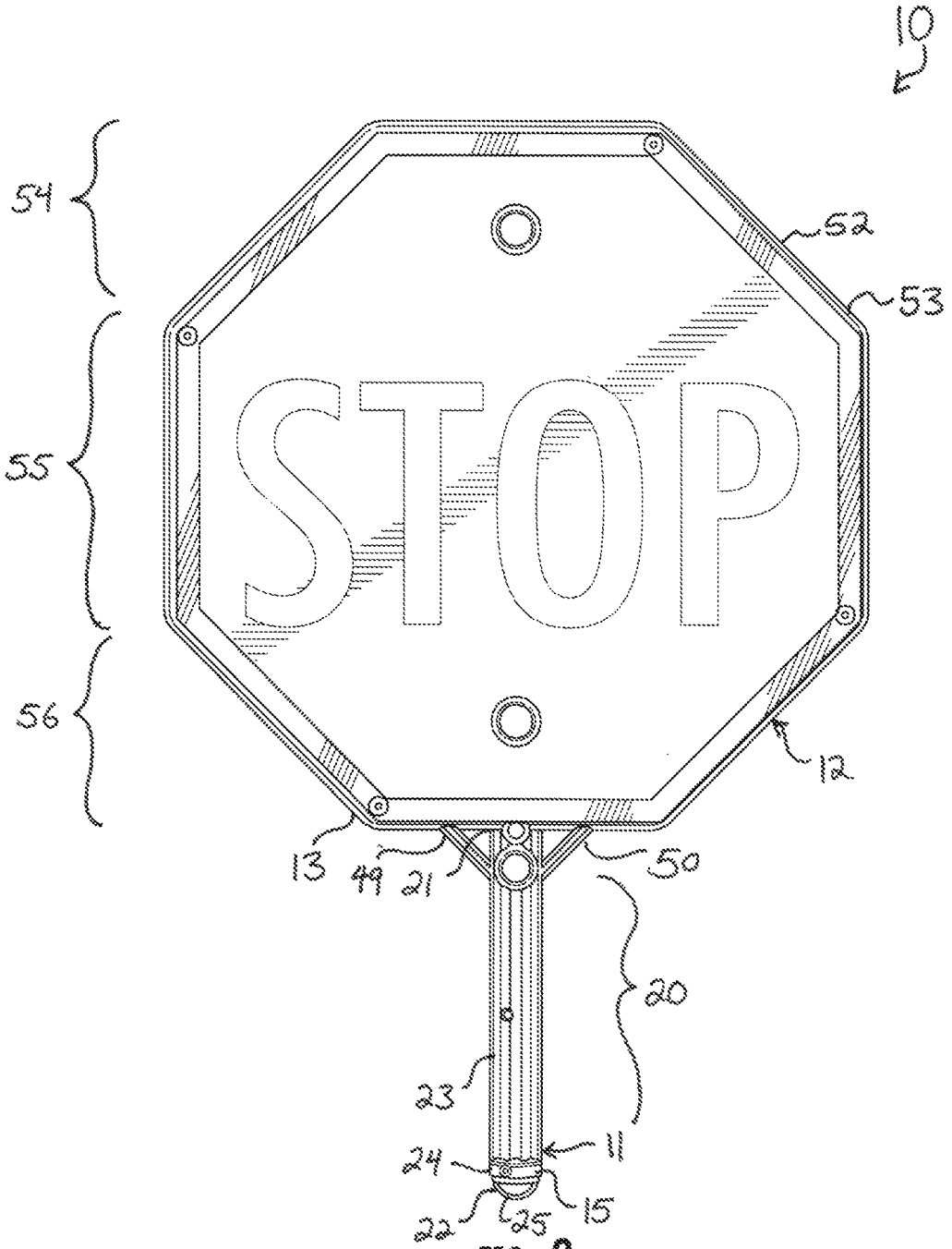
FIG. 2 is an elevation view of a back half of the paddle of FIG. 1.

Reference now is made to the drawings, in which the same reference characters are used throughout the different figures to designate the same elements. FIG. 1 illustrates an illuminated traffic control paddle 10 (hereinafter, the "paddle 10") constructed and arranged according to the principle of the invention, as the paddle 10 would appear being held in operation by the hand of a crossing guard. The paddle 10 is a hand-wielded paddle for use at crosswalks, such as those which schoolchildren use to cross from one side of a street to another side of the street. The paddle 10 includes a handle 11 and a head 12 affixed to the handle 11. A bifurcated frame 13 forms the body of the paddle 10, the frame 13 being constructed from front and back halves 14 and 15 mated together. The front and back halves 14 and 15 are each separate monolithic pieces, preferably constructed from a material or combination of materials having rigid and light material characteristics, such as plastic, which plastic is preferably colored white but may also be colored red, black, or some other color. The front and back halves 14 and 15 are preferably formed in a mold, such as an injection mold. The front and back halves 14 and 15 are joined together, such as with screws, rivets, an adhesive, or by sonic welding. A continuous seam is formed between the front and back halves 14 and 15, and tape applied over the seam further reinforces the mating of the front and back halves 14 and 15. The front and back halves 14 and 15 are identical in every respect, except as otherwise noted herein, and as such, reference will be made primarily to the front half 14 with the understanding that the discussion applies equally to the back half 15. The reference characters used for the structural elements and features on the front half 14 will also be used on the back half 15 throughout the drawings as is appropriate. FIG. 1 is a front view of the paddle 10, showing the front half 14, while FIG. 2 is a rear view of the paddle 10, showing the back half 15.

The handle 11 is a rigid attachment extending from and formed integrally to the head 12. The handle 11 includes a grip 20 that extends between a top 21 of the handle 11 and a bottom 22 of the handle 12. The grip 20 is generally cylindrical, and has a multi-faceted sidewall 25 that is generally cylindrical, as shown in FIG. 1. The multi-faceted exterior sidewall 23 provides a plurality of gripping faces and locations for a human hand, and the grip 20 is sized so as to be comfortable when held in a hand, with the grip 20 having a length between the top 21 and bottom 22 of approximately eight inches (approximately 20.3 centimeters). The bottom 22 of the handle 11 has an integral ring 24 formed on the grip 20, and a loop 25 which depends downwardly from the ring 24. The exterior surface of the ring 24 extends just beyond the exterior surface of the grip 20. The ring 24 thus defines a cuff or projection beyond the exterior surface of the grip 20 which provides a different tactile experience from that of the grip 20, thus allowing an operator to feel where the grip 20 ends proximate to the bottom 22 of the handle 11, and thus allowing the operator to keep the paddle 10 from slipping out of his or her hands. The loop 25 is an arcuate projection extending from one side of the grip 20 to the other side of the grip 20. The loop 25 is parallel to the head 12. The loop 25 is formed integrally with the ring 24 to the grip 20, and is a strong, rigid extension thereof. The loop 25 is useful for attaching a lanyard tied or looped about the operator's wrist, so that, when the operator of the paddle 10 wishes to let go of the paddle 10, the paddle 10 can dangle from the operator's wrist.

Figure 3:
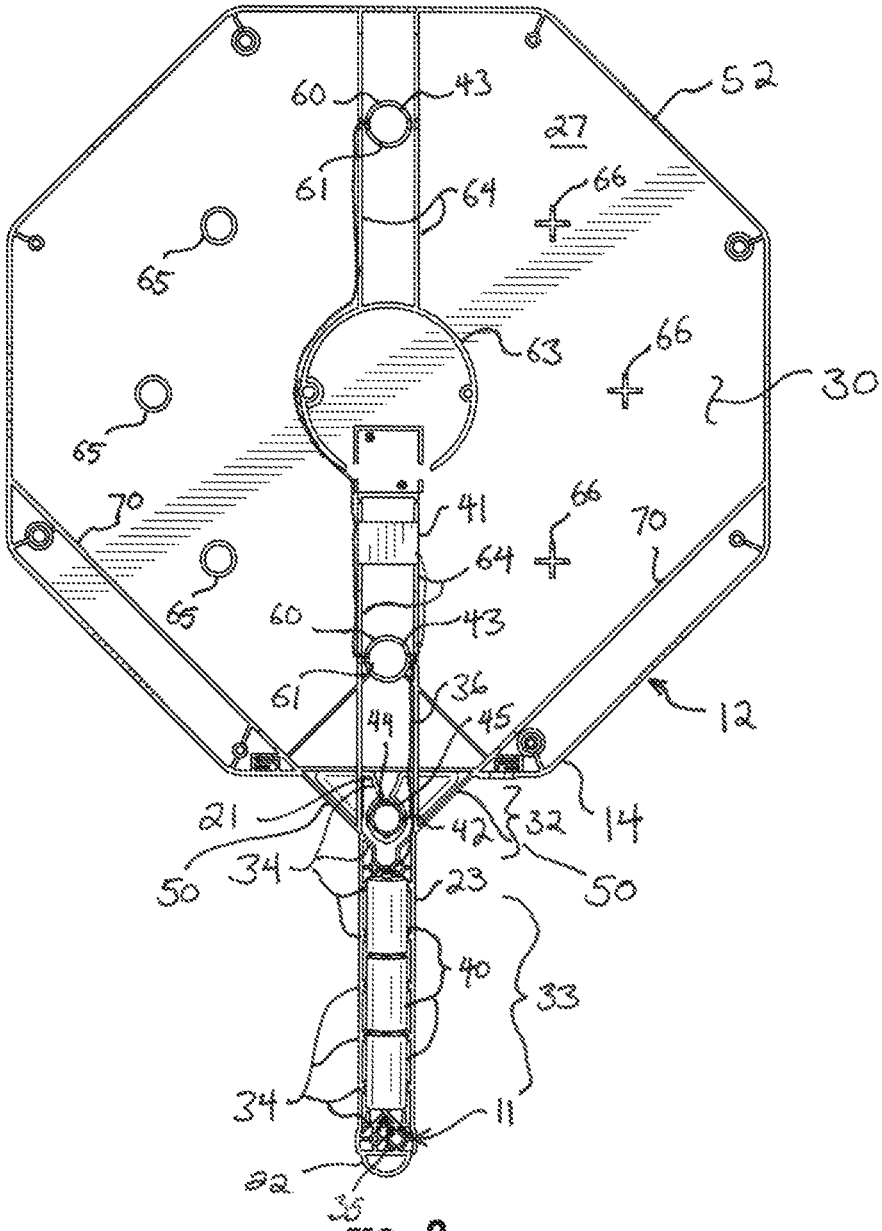
FIG. 3 is an elevation view of an interior of the paddle of FIG. 1.

The handle 11 is formed cooperatively between the front and back halves 14 and 15 of the frame 13. A heat-shrink wrap is preferably formed over the handle 11 to aid in holding the front and back halves 14 and 15 of the handle 11 together. FIG. 3 illustrates a rear view of the front half 14 with the back half 15 of the frame 13 separated therefrom. FIG. 3 is, in other words, a section view taken along a line bifuracting the front and back halves 14 and 15 of the frame 13, which line lies in the plane of the drawing paper in both FIGS. 1 and 2. Contrasted with an outside 26 of the front half 14 seen in FIG. 1, FIG. 3 shows an inside 27 of the front half 14. Further, an interior 30 of the frame 13 is exposed in the view of FIG. 3. The interior 30 of the frame 13 is bound and defined between the inside 27 of the front half 14 and the inside of the back half 15. It will be understood that the inside of the back half 15 is identical to the inside 27 of the front half 14, except as will be described herein. As can be seen in this view, the handle 11 has an upper portion 32 and an opposed lower portion 33.

The upper portion 32 of the handle 11 extends from the top 21 of the grip 20 to a location intermediate with respect to the top 21 and bottom 22 of the grip 20. The upper portion 32 is internally reinforced with structural ribs 34 which extend throughout the upper portion 32 between the sidewall 23. The ribs 34 provide the upper portion 32 with axial rigidity along its length. Briefly, as the term is used here, "axial" generally means along the length of the handle 11 between the top 21 and bottom 22, and the term "radial" will correspond to a direction extending inwardly or outwardly through a center of the head 12 and generally in the same plane as the head 12.

The lower portion 33 of the handle 11 extends from the bottom 22 of the grip 20 to a location intermediate with respect to the top 21 and bottom 22 of the grip 20, just below the upper portion 32. The lower portion 33 is also internally reinforced with the ribs 34. The ribs 34 extending through the lower portion 33 extend diagonally throughout the lower portion 33 between the sidewall 25 and terminate at inner ends just within the sidewall 25, so as to define a hollow cylindrical chamber 35 within the lower portion 33 of the grip 20. The chamber 35 is sized to hold batteries 40 to provide power to the paddle 10. The batteries are preferably small batteries, such as those known as "Sub C" batteriesm providing approximately 2000 mA of current. Electrical contacts at either end of the chamber 35 are coupled to the batteries 40 and to a circuit board 41 contained in the head 12 of the paddle 10 for powering the circuit board 41.

The circuit board 41 controls the illumination and pattern of illumination of the paddle 10. Referring to both FIGS. 1 and 3, the circuit board 41 is energized by a switch 42 carried at the top 21 of the grip 20. As seen in FIGS. 1 and 2, the switch 42 is a rocker switch, a binary on-off switch, which provides a positive snap action when moved between on and off positions, and which has a short throw handle or low head that clicks in response to moving between the on and off positions. The switch 42 has a low profile in which the head projects only slightly beyond the exterior surface of the grip 20. This allows the operator to easily brush the switch into the on or off position with an upward or downward swipe of his or her thumb.

The switch 42 is disposed between the top 21 of the handle 11 and the lower portion 33. Generally, the switch 42 is located in an intermediate position in the upper portion 32 of the handle 11 just below the top 21. The switch 42 is electrically disposed between the batteries 40 and the circuit board 41, with a wire 36 extending from the contacts holding the batteries 40 to the toggle switch 42, and from the toggle switch 42 to the circuit board 41. In the off position of the switch 42, power is not transmitted from the batteries 40 to the circuit board 41, and the circuit board 41 is not energized. In the on position of the switch 42, power is transmitted from the batteries 40 to the circuit board 41, and the circuit board 41 is energized.

The circuit board 41 is electrically coupled to light-emitting diodes ("LEDs") 43 in the paddle 10. The circuit board 41 contains pre-programmed logic which instructs power to be transmitted to the LEDs 43 according to pre-programmed instructions, so as to energize the LEDs 43 in a predefined manner, which will be discussed later. A heat sink is mounted proximate to and in contact with the circuit board 41 to dissipate heat therefrom. The circuit board 41 includes a fuse to prevent damage that may occur from accidental overcharging of the batteries 40, from a surge in power through the circuit board 41, or from various other hazards. The circuit board 41 is also pre-programmed with logic to instruct the LEDs 43 on the front half 14 only to blink, preferably faster or slower than fifty to sixty blinks per minute, when the charge on the batteries 40 is low. In this way, the LEDs 43 provide a warning signal to the operator that the batteries 40 are low on power and need to be recharged. In a preferred operating mode, the LEDs 43 double blink, or blink twice in rapid succession, so as to produce a strobe effect.

Figure 4:
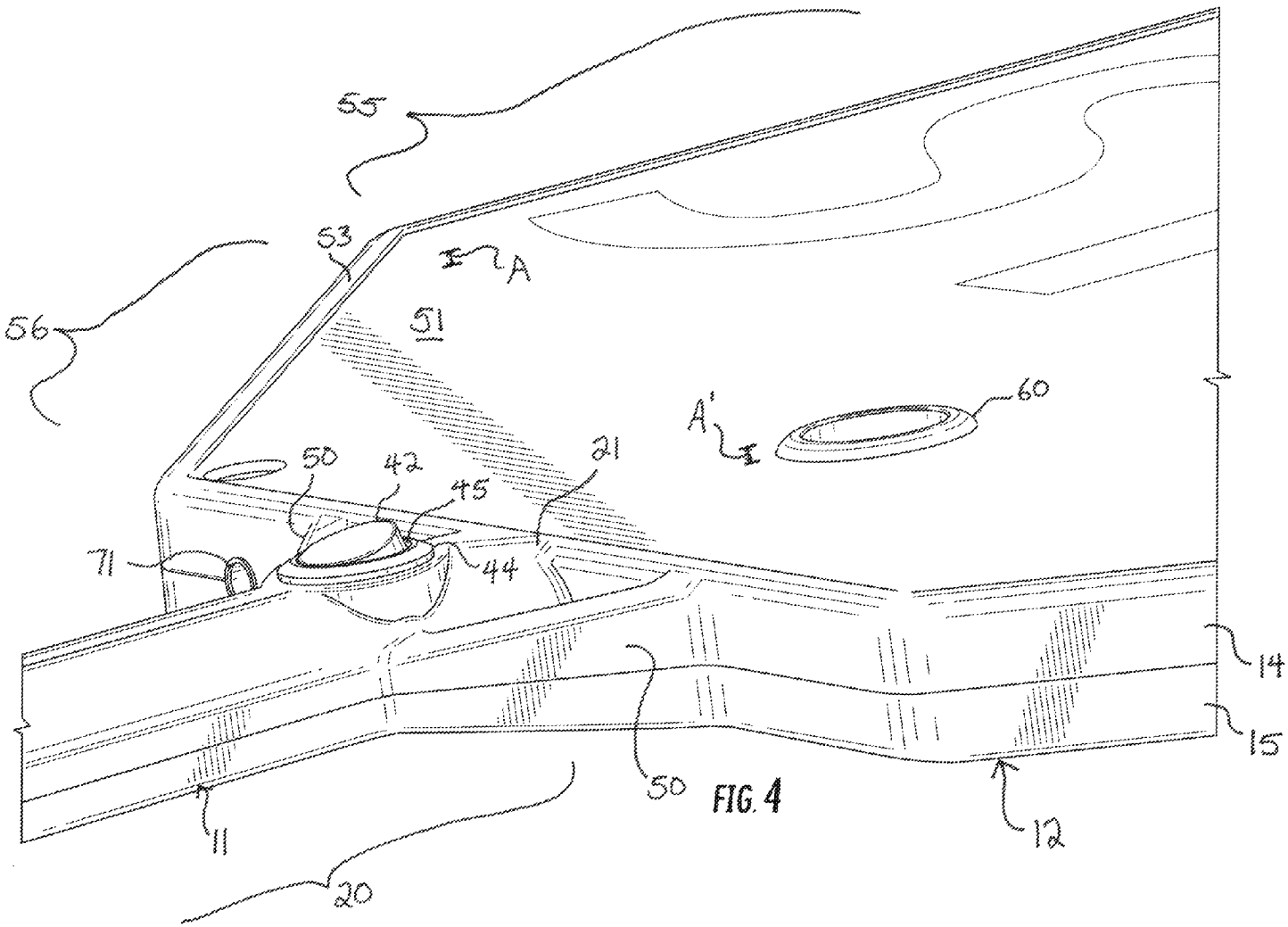
FIG. 4 is an enlarged perspective view of the front half of the paddle of FIG. 1.

With reference to FIG. 3 again, the switch 42 is mounted just below the top 21 of the handle 11 in a circular mount 44 having a bore 45 through the mount 44. The switch 42 preferably has an accordion boot between the head and the mount 44 to prevent the intrusion of dust, dirt, and water into the handle 11. The head of the switch 42 projects out of the mount 44, as seen in FIG. 4. The switch 42, and the mount 44 and bore 45, are formed only in the front half 14 of the paddle 10; those features are not on the back half 15. The area of the handle 11 to which the switch 42 corresponds on the back half 15 is instead occupied by a blank in the frame 13.

Referring now to FIG. 1, laterally flanking the switch 42 are opposed braces 49 and 50 extending diagonally outwardly away from proximate to the switch 42 in the handle 11 to the head 12. Though the handle 11 is formed integrally to the head 12 of the paddle 10, the struts 49 and 50 provide rigidity to the juncture between the handle 11 and head 12, preventing rotation and flexing of the handle and head 12 with respect to each other. The struts 49 and 50 are braces having opposed ends formed integrally to the handle 11 and head 12, the struts 49 and 50 have bodies between the opposed ends which are separate from external to the handle 11 and head 12, and the struts 49 and 50 thus extend outwardly from the frame 13 between the handle 11 and the head 12.

Turning now back to FIG. 1, the head 12 includes a generally flat face 51 bound by a marginal edge or perimeter 52. The perimeter 52 shown in FIG. 1 is octagonal, and one having ordinary skill in the art will readily appreciate that the perimeter 52 may have some other shape or configuration. A lip 53 is formed along the perimeter 52, and the lip 53 is upstanding with respect to the face 51, projecting upwardly from the face 51 and normal to the face 51, such that the face 51 is recessed with respect to the lip 53 along the perimeter 52. The lip 53 extends continuously around the face 51, and projects upwardly on both front and back halves 14 and 15.

The face 51 has a diameter extending across the face 51 which is between approximately eighteen inches and twenty-four inches (between approximately 45.7 centimeters and 60.9 centimeters). The face 51 has three regions, including a top third 54, a middle third 55, and a bottom third 56, identified in FIG. 1. Though enumerated here as "thirds," it should be understood that each of the top, middle, and bottom thirds 54, 55, and 56 are not necessarily one-third the diameter of the face 51 in height, nor are they necessarily each identical in size. Indeed, the middle third 55 is generally rectangular in shape, while the top and bottom thirds 54 and 56 are generally trapezoidal, though in opposite orientations. Each of the top, middle, and bottom thirds 54, 55, and 56 has a purpose during operation of the paddle 10, as will be explained.

The LEDs 43 are carried in circular mounts or annular projections 60 of the frame 13 having bores 61 through the projections 60. The LEDs 43 are recessed within those projections 60. The projections 60 are integrally formed in and as part of the frame 13, and project beyond the face 51 of the head 12 a distance equal to that which the lip 53 projects beyond the face 51. As seen in FIG. 4, which is an enlarged view of the top 21 of the grip 20, the bottom third 56, a portion of the middle third 55 of the head 12, the lip 53 at the perimeter 52 projects beyond the face 51 by a distance A, and the projection 60 projects beyond the face 51 by a distance A'. The distances A and A' are equal to each other. In other words, the face 51 is recessed with respect to the perimeter 52 by a distance A and with respect to the projection 60 by a distance A'. The LEDs 43 are aligned along an axis B which extends axially through both of the LEDs 43, a geometric center of the head 12, and through the handle 11, as shown in FIG. 1.

In the preferred embodiment shown in FIGS. 1-4, two LEDs 43 are carried in each of the front and back halves 14 and 15. In other embodiments, each of the front and back halves 14 and 15 carries four LEDs 43. In those embodiments, a pair of horizontally-aligned, spaced-apart LEDs 43 are disposed in the top third 54, and a pair of horizontally-aligned, spaced-apart LEDs 43 are disposed in the bottom third 56, so as to define a rectangular arrangement of four LEDs 43 encircling the sensible literal indicia in the middle third 55.

An applique 62 is applied to the face 51 of the head 12. The applique 62 has the same dimensions as the face 51 and is configured to correspond to and fit onto the face 51 entirely within the perimeter 52. The applique 62 has an adhesive backing for application to the face 51 and has a reflective front surface 59. The reflective front surface 59 carries sensible literal indicia, such as the word "STOP" to be disposed in the middle third 55 of the head 12. The applique 62 is also formed with holes above and below the sensible literal indicia, corresponding to the projections 60 for the LEDs 43 in the top and bottom thirds 54 and 56. Thus, when applied to the face 51, the sensible literal indicia lies over the middle portion 55, a hole lies over the LED 43 in the top portion 54, and a hole lies over the LED 43 in the bottom portion 56. In preferred embodiments, the applique 62 has a red reflective surface with the sensible literal indicia appearing in contrasting white and also being reflective. In some embodiments, a reflective white border may extend about the edge of the applique 62. In this way, the applique 62 presents a bright, reflective, highly-visible sign to traffic. The applique 62 is fit onto the face 51 entirely within the perimeter 52 and covers the screws, rivets, or other fasteners which secure the front and back halves 14 and 15 of the frame 13 to each other.

In operation, the paddle 10 is held by hand and is strong, durable, and rigid so that it can be used frequently without needing more than regular maintenance. The head 12 provides and maintains rigidity across the face 51 with reinforcing structures formed along the interior 30 of the head 12. Turning back to FIG. 3, those reinforcing structures are shown. An annular central rib 63 is formed in the middle third 55, and a plurality of straight ribs 64 extend generally radially outward therefrom to the perimeter 52. A space for the circuit board 63 is formed just below the central rib 63, between the central rib 63 and the LED 43 in the bottom third 56. The ribs 64 extend radially outward from the central rib 63 to the perimeter 52 on either side of the bores 61 in each of the top and bottom thirds 54 and 56. Two ribs 70 extend outwardly from the bottom of the head 11, just above the top 21 of the handle 11 between the perimeter 52, diverging from proximate to the handle 11 to the perimeter 52. These ribs 70 are aligned with, and extend directly outwardly from, the struts 49 and 50 formed between the handle 11 and the head 12, providing structural rigidity between the handle 11 and head 12. The alignment of the ribs 70 and the struts 49 and 50 prevents flexing between the handle and the head 11 and 12, so that the paddle 10 can be wielded, rotated, and generally moved as may be needed during operation without damaging the paddle 10 or weakening its durability.

Three engagement points are also spaced across the interior 30 of the head 12. The engagement points are formed between circular sockets 65 and cross-shaped posts 66. The posts 66 on the back half 15 fit within the sockets 65 on the front half 14, and the posts 66 on the front half 14 fit within the sockets 65 on the back half 15. The posts 66 mate with and fit into the sockets 65, binding the front and back halves 14 and 15 together and preventing both lateral movement of the front and back halves and also depression of the front and back halves 14 and 15 toward each other and into the interior 30.

The batteries 40 in the handle 11 are rechargeable. Referring briefly to FIG. 4, an electrical port 71 formed near the bottom of the head 12 proximate to the top 21 of the grip 20 is coupled in electrical communication with the batteries 40. The port 71 accepts a charging cord, with which the batteries 40 can be charged during the night or whenever not in use. The circuit board 41 controls the charging of the batteries 40 and will prevent accidental over-charging by terminating charging once the batteries 40 are fully charged.

During operation, the paddle 10 is held by an operator, such as a crossing guard at a school crosswalk, and is used to control traffic. When children walk through the crosswalk, and traffic must be stopped, the paddle 10 is raised with each of the two faces 51 presented toward traffic, and the switch 42 is moved to the on position, as by depressing with a finger or thumb. Because the switch 42 has a low profile, as seen in FIG. 4, it is difficult for the operator to accidentally move the switch 42, thus preventing the operator from accidentally turning the paddle 10 on or off. When the switch 42 is moved to the on position, the circuit board 41 receives power, and the onboard pre-programmed logic instructs the LEDs 43 to operate according to a predefined program. The LEDs 43 will then blink. Preferably, the LEDs 43 will strobe by flashing twice rapidly, each double-blink occurring at between fifty to sixty times per minute. The LEDs operate according to the program written into the onboard pre-programmed logic of the circuit board 41. The LEDs 43 may be white LEDs, red LEDs, yellow LEDs, or some other color useful for attracting a driver's attention. In one program, the LEDs 43 on one face 51 blink alternately, with the LED 43 in the top third 54 blinking on when the LED 43 in the bottom third 56 blinks off, and with the LED 43 in the top third 54 blinking off when the LED 43 in the bottom third 56 blinks on. Moreover, the LEDs 43 on opposing faces 51 blink alternately, with the LED 43 in the top third 54 on the front half 14 blinking on when the LED 43 in the top third 54 on the back half 15 blinks off, with the LED 43 in the top third 54 on the front half 14 blinking off when the LED 43 in the top third 54 on the back half 15 blinks on, with the LED 43 in the bottom third 56 on the front half 14 blinking on when the LED 43 in the bottom third 56 on the back half 15 blinks off, and with the LED 43 in the bottom third 56 on the front half 14 blinking off when the LED 43 in the bottom third 56 on the back half 15 blinks on. In this way, the paddle 10 creates a unique pattern of lights to attract and catch a driver's attention while also using a minimum of power. When the children have cleared the crosswalk, the operator turns the switch 42 to the off position, and the supply of power to the circuit board 41 is discontinued, thus turning the LEDs 43 off.

When the paddle 10 is not in use, it is returned to a storage location. The charging cord is plugged into the port 71 to recharge the batteries 40, and the paddle 10 is left to charge until its next use. In school settings, several paddles 10 may be used, and a central storage and charging location may be designated. The several paddle 10 can be stacked on top of each other, with the head 12 of one paddle 10 stacked on the head 12 of another. Because the faces 51 and the LEDs 43 are recessed with respect to the lip 53 along the perimeter 52 and the projection 60 around the LEDs 43, the applique 62 will not be damaged, nor will the LEDs 43, thus extending the life of each paddle 10.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A traffic control paddle consisting of:

a frame including a handle and a head having two sides;

one side of the head of the frame includes a perimeter and a face inset within the perimeter;

the face is recessed with respect to the perimeter, and has a surface carrying literal indicia;

individual and separate annular projections are formed integrally to the frame as part of the frame and project above the face a distance level with the perimeter;

the surface of the face is recessed a first distance with respect to the perimeter, is recessed a second distance with respect to the annular projections, and the first and second distances are equal;

a light-emitting diode is seated within and into each of the annular projections, each light-emitting diode being continuously encircled by a respective one of the annular projections; and each light-emitting diode is recessed with respect to the respective one of the annular projections into which the light-emitting diode is seated;

wherein the light-emitting diodes are only located above and below the literal indicia on the surface.

2. The traffic control paddle of claim 1, further consisting of opposed first and second structural braces extending from the handle to the head externally of the handle and head, each brace defining a rigid support for the head.

3. The traffic control paddle of claim 2, further consisting of:

structural ribs extend within the head of the frame on an inside of the head, opposed from the face of the head;

first and second structural ribs extend within the head of the frame from proximate to the handle outward to the perimeter of the head; and the first and second structural ribs diverge from proximate to the handle to the perimeter.

4. The traffic control paddle of claim 3, wherein the first and second structural ribs are aligned with and extend outwardly from the first and second structural braces, respectively.

5. The traffic control paddle of claim 1, wherein each light-emitting diode is powered by a battery carried in the handle of the frame.

6. The traffic control paddle of claim 5, wherein the light-emitting diodes are energized by depressing a switch carried in the handle.

7. The traffic control paddle of claim 6, wherein the switch is disposed between the head and the batteries in the handle.

8. A traffic control paddle consisting of:

a frame including a handle and a head having two sides, the frame formed from two halves mated together;

one side of the head of the frame includes a perimeter and a face inset within the perimeter;

the face is recessed with respect to the perimeter, and has a surface carrying literal indicia, wherein the surface of the face is recessed a first distance with respect to the perimeter, is recessed a second distance with respect to the annular projections, and the first and second distances are equal;

individual and separate annular projections are formed integrally to the frame and extend through the face and above the face a distance level with the perimeter;

a light-emitting diode is seated within and into each of the annular projections, each light-emitting diode being continuously encircled by a respective one of the annular projections; and each light-emitting diode is recessed with respect to the respective one of the annular projections into which the light-emitting diode is seated;

wherein the light-emitting diodes are only located above and below the literal indicia on the surface.

9. The traffic control paddle of claim 8, further consisting of opposed first and second structural braces extending from the handle to the head externally of the handle and head, each brace defining a rigid support for the head.

10. The traffic control paddle of claim 9, wherein:

the halves of the frame each have an outside and an inside;

the insides of the halves of the frame define an interior of the frame;

structural ribs extend within the interior of the frame;

first and second structural ribs extend within the interior from proximate to the handle outwardly to the perimeter of the head; and the first and second structural ribs diverge from proximate to the handle to the perimeter.

11. The traffic control paddle of claim 10, wherein the first and second structural ribs are aligned with and extend outwardly from the first and second structural braces, respectively.

12. The traffic control paddle of claim 8, wherein each light-emitting diode is powered by a battery carried in the handle of the frame.

13. The traffic control paddle of claim 12, wherein the light-emitting diodes are energized by depressing a switch carried in the handle.

14. The traffic control paddle of claim 13, wherein the switch is disposed between the head and the batteries in the handle.

15. A traffic control paddle consisting of:

a head including a perimeter, a face inset within the perimeter, a surface on the face carrying literal indicia, and an upstanding lip extending around the perimeter and projecting above the face by a first distance;

individual and separate annular projections projecting above the face by a second distance equal to the first distance;

two offset light-emitting diodes in the face, each seated within and into a respective one of the annular projections, each being level with the surface on the face and being encircled by the respective one of the annular projections;

a handle integrally formed to the head carrying batteries for powering the light-emitting diodes;

opposed first and second structural braces extending from the handle to the head externally of the handle and head, each brace defining a support for the head; and a switch carried in the handle and operatively coupled to the light-emitting diodes to provide power to the light-emitting diodes in response to activation of the switch;

wherein the light-emitting diodes are spaced above and below the literal indicia on the surface.

16. The traffic control paddle of claim 15, further consisting of:

structural ribs extend within the head of the frame on an inside of the head, opposed from the face of the head;

first and second structural ribs extend within the head of the frame from proximate to the handle outward to the perimeter of the head; and the first and second structural ribs diverge from proximate to the handle to the perimeter.

17. The traffic control paddle of claim 16, wherein the first and second structural ribs are aligned with and extend outwardly from the first and second structural braces, respectively.

* * * * *